United States Patent [19]

Pabis

[11] Patent Number: 4,597,375

[45] Date of Patent: Jul. 1, 1986

[54] WOOD BURNING FURNACE

[76] Inventor: David M. Pabis, 211-43rd St., Bloomingdale, Mich. 49026

[21] Appl. No.: 697,479

[22] Filed: Feb. 1, 1985

[51] Int. Cl.[4] ..... F24H 3/12

[52] U.S. Cl. ..... 126/117; 126/99 D; 126/109; 126/242; 126/245

[58] Field of Search ..... 126/99 A, 99 D, 117, 126/109, 104, 102, 112, 77, 245, 242, 163 A, 121, 131, 99 R, 110 R; 110/317, 318, 322, 326

[56] References Cited

U.S. PATENT DOCUMENTS

| | | | |
|---|---|---|---|
| 662,107 | 11/1900 | Abbs et al. | 126/117 |
| 2,810,380 | 10/1957 | Critten | 126/104 R |
| 4,074,854 | 2/1978 | Kamper | 126/110 R X |
| 4,122,825 | 10/1978 | Slate | 126/121 |
| 4,128,094 | 12/1978 | Lewis | 126/110 |
| 4,140,101 | 2/1979 | Glover | 126/110 |
| 4,150,658 | 4/1979 | Woods | 126/63 |
| 4,154,210 | 5/1979 | Jaymes et al. | 126/34 |
| 4,192,285 | 3/1980 | Nietupski | 126/83 |
| 4,196,713 | 4/1980 | Blankenship et al. | 126/77 |
| 4,201,185 | 5/1980 | Black . | |
| 4,204,517 | 5/1980 | Rumsey | 126/63 |
| 4,206,743 | 6/1980 | Niemala | 126/110 |
| 4,217,876 | 8/1980 | Gee | 126/99 R |
| 4,228,783 | 10/1980 | Kalenian | 126/112 |
| 4,263,889 | 4/1981 | Martenson | 126/121 X |
| 4,300,526 | 11/1981 | McKay et al. | 126/67 |
| 4,334,517 | 6/1982 | Sweitzer | 126/121 |
| 4,335,703 | 6/1982 | Klank | 126/121 |
| 4,347,831 | 9/1982 | Graziano | 126/83 |
| 4,350,139 | 9/1982 | Robichaud | 126/77 |
| 4,368,722 | 1/1983 | Lynch | 126/77 |
| 4,385,620 | 5/1983 | Black | 126/77 |

*Primary Examiner*—Randall L. Green

*Attorney, Agent, or Firm*—Price, Heneveld, Huizenga & Cooper

[57] ABSTRACT

A maximum efficiency stove or furnace for heating homes or other buildings is disclosed. The furnace includes a combustion chamber supported within a furnace housing by an ash pan. The combustion chamber is spaced apart from the furnace housing to define an air circulation chamber therebetween. A horizontal flue extends through the upper portion of the air circulation chamber, from the rear of the combustion chamber to the front of the top wall of the furnace housing. The ash pan includes a number of heat transfer tubes projecting therethrough to define a grate upon which the fuel is burned and a secondary grate below the heat transfer tubes. The furnace also includes an ambient air preheating chamber attached to the outside surface of the housing. The air to be heated is drawn through the preheating chamber and admitted into the air circulation chamber, whereupon it flows through the heat transfer tubes, around the combustion chamber and flue, and is then exhausted into the room to be heated. The air absorbs radiant energy throughout its journey through the preheating chamber, heat transfer tubes, and air circulation chamber.

11 Claims, 4 Drawing Figures

WOOD BURNING FURNACE

BACKGROUND OF THE INVENTION

This invention relates to wood or coal burning devices such as stoves or furnaces.

It has long been recognized that wood and coal contains a very substantial potential of thermal energy which can be released by burning. The early wood or coal burning furnaces were, however, very inefficient in utilizing the thermal energy released during combustion. In most of these stoves or furnaces, ambient air was heated by being brought into contact with the outside walls of the furnace. A problem associated with these furnaces is that most of the thermal energy generated during combustion is lost through the flue or chimney.

One way to increase the efficiency of heat exchange is to suspend a fire or combustion chamber within a housing so as to create an air chamber through which the air to be heated can circulate. The air in the chamber is heated by the thermal energy passing through the walls of the fire chamber. For example, in U.S. Pat. No. 4,140,101 to Glover, entitled WOOD BURNING STOVE WITH FORCED AIR HEATING and U.S. Pat. No. 4,206,743 to Niemela, entitled WOOD BURNING APPARATUS, air enters the air chamber through an inlet located near the bottom of the air chamber, rises by convection current through the chamber, and then exits out an air outlet located near the top of the chamber. Ambient air is thus heated by passing through the air chamber adjacent to the fire chamber as well as by coming into direct contact with the outside walls of the furnace housing.

In U.S. Pat. No. 4,128,094 to Lewis, entitled HEATER, air is circulated in a circular pattern around the fire chamber in order to increase the surface area in which the circulating air is exposed to the hot fire chamber walls.

The above stoves or furnaces are much more efficient than stoves which do not incorporate an air circulation chamber Nonetheless, the bulk of the heat generated by combustion is still lost through the flue.

Another disadvantage to many wood burning furnaces is that the log grate is suspended within the fire chamber itself. The ashes falling to the bottom of the fire chamber act as an insulator to decrease the transfer of thermal energy across the chamber walls below the grate. This causes an increase in heat loss through the chimney, thereby decreasing the efficiency of the system.

Therefore, a need exists for a wood or coal burning device which includes structures whereby the maximum amount of heat may be extracted from the device by the ambient air circulating through it. Further, a need exists for a wood or coal burning furnace which can easily and safely be maintained.

SUMMARY OF THE INVENTION

The features of the present invention solve many of the problems associated with the prior art furnaces, the result of which is to substantially increase the heating efficiency of wood or coal burning furnaces. In one aspect, the furnace of the present invention includes a preheating chamber and duct system which are attached directly to the outer surface of the furnace housing. Air is first drawn into this preheating system and preheated before it is admitted into an air circulation chamber. This preheating of the air has been found to substantially increase the heating capacity of the system.

In another aspect, the furnace of the present invention includes a combustion chamber supported in a furnace housing with an ash pan assembly located under the combustion chamber. A number of heat transfer tubes extend through the ash pan assembly, immediately below the combustion chamber. The logs to be burned are placed on these tubes. Set below the tubes is a grate for catching burning cinders that fall through the spaces between the tubes. An air circulation chamber completely surrounds the combustion chamber for passing ambient air for heating. The furnace further includes an air intake means for admitting air into the air circulation chamber. Air, upon being admitted into the air circulation chamber, passes through the heat transfer tubes, where it is heated by the fire burning directly on the tubes' upper surface and by the burning cinders located below the lower surface of the tubes, and then around the remainder of the air circulation chamber, where it is heated by the surfaces of the combustion chamber. The heated air is then exhausted out into the area to be heated through an air outlet opening. The combination of circulating air through heat exchange tubes which are directly heated on both their upper and lower surfaces and of placing the fire grate below the combustion chamber so that the entire surface of that chamber is heated substantially increases the efficiency of heat exchange.

Other aspects of the invention include a horizontal flue which extends from the rearward end to the frontward end of the furnace, through the portion of the air circulation chamber located between the top of the furnace housing and the top of the combustion chamber. The air passing above the combustion chamber swirls around the exposed walls of the flue to pick up thermal energy being transferred across the flue walls into the air circulation chamber. One lower wall of the flue is inclined at an angle causing creosote formed by the flue gases to run down such wall and fall into the combustion chamber where it is burned. The flue also has a door for gaining access to its interior for periodically cleaning out unburnt creosote deposits.

The above features provide numerous advantages over prior known stoves. The present stove operates at a much greater efficiency since thermal energy is extracted from the external surface of the furnace, all the sides of the combustion chamber, the heat transfer tubes and the horizontal flue. Further, by using a secondary grate, heat is extracted from burning cinders which usually are extinguished in the pile of the ashes below the burning logs.

These and other objects, advantages, purposes and features of the invention will become more apparent from a study of the following description taken in conjuction with the drawings.

DESCRIPTION OF THE PREFERRED EMBODIMENT

Figure 1:
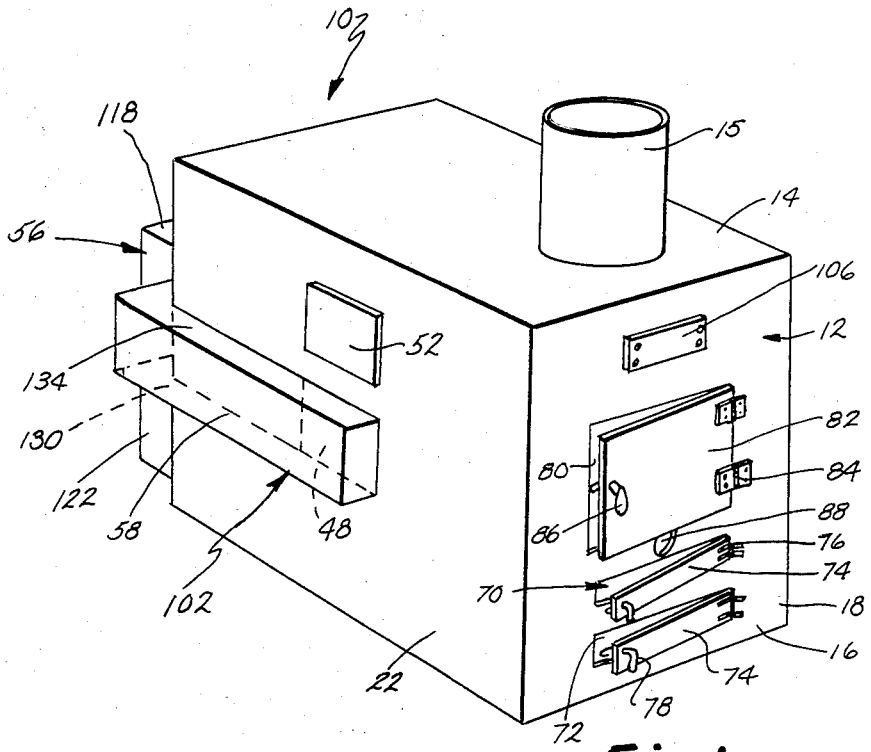
FIG. 1 is a front, perspective view of the heating stove or furnace of the present invention.

Referring to the drawings, numeral 10 designates the wood burning stove of the present invention. Furnace 10 includes a furnace housing 12 having top and bottom walls 14 and 16, respectively, front and rear walls 18 and 20, respectively, and a pair of opposite sidewalls 22, 24. A combustion chamber 26 is provided. Chamber 26 is formed by the cylinder 30 which includes the upper and lower wall portions 32 and 34, respectively, and the lateral wall portions 36 and 38. Combustion chamber 26 is supported in housing 12 by ash pan assembly 40 and is closed at both ends by front wall 28 and rear wall 29. Wall portions 32, 34, 36 and 38 of combustion chamber 26 are spaced inwardly from walls 14, 16, 22 and 24 of housing 12 to define an air circulation chamber 44 therebetween. A number of hollow, spaced apart heat transfer tubes 42 span the space between sidewalls 66 of ash pan assembly 40 and define a primary grate for supporting the logs to be burned. Combustion gases from the fire burning within combustion chamber 26 are exhausted from the stove through the horizontally inclined flue 46 which extends through the portion of air circulation chamber 44 located above combustion chamber 26.

Sidewall 22 of housing 12 is provided with an air inlet opening 48 (FIGS. 1, 2 and 3) for admitting air into air circulation chamber 44 and an air outlet opening 52 for exhausting air from the air circulation chamber. Situated between air inlet opening 48 and air outlet opening 52 is a baffle 54 (FIG. 3) which spans air circulation chamber 44, one end being connected to sidewall 22 and the other end to combustion chamber 26. Baffle 54 causes the air to flow in a counterclockwise direction as indicated by the arrows.

Furnace 10 further includes an air preheating chamber 56 attached to one of the walls of housing 12 immediately adjacent the rear of chamber 26. A duct 58 extends between preheating chamber 56 and air inlet opening 48 along the housing 22.

Figure 4:
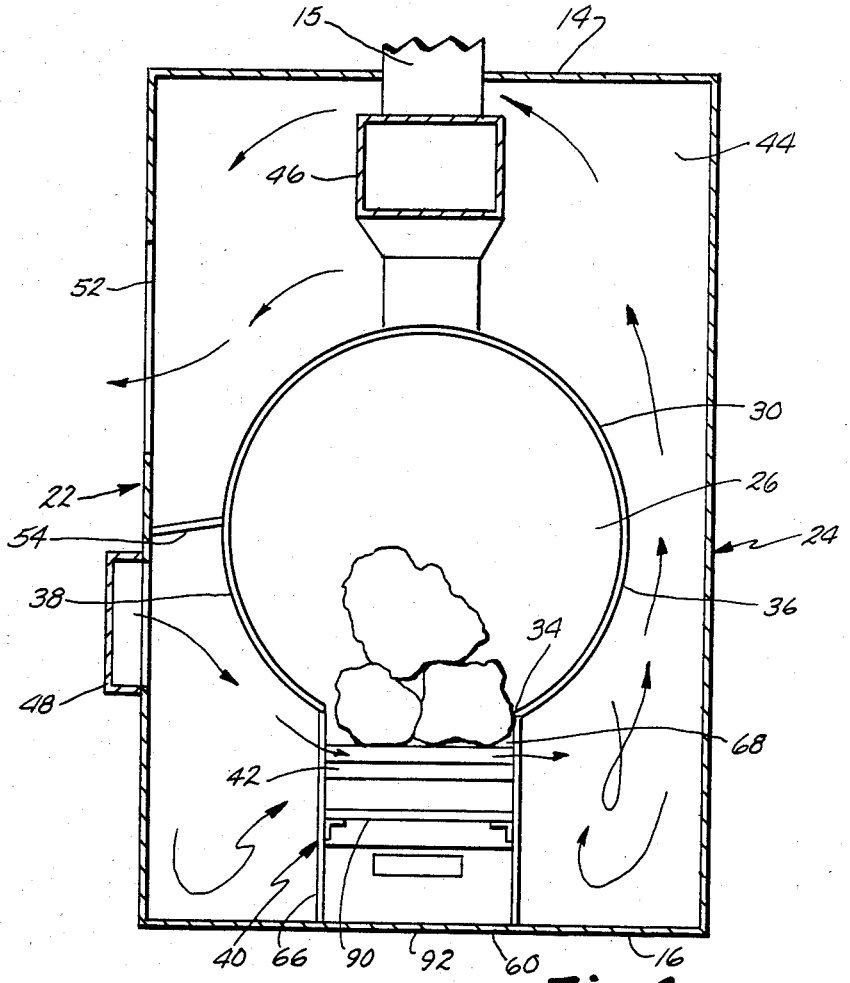
FIG. 4 is a sectional front elevation of the heating stove or furnace taken along line III—III of FIG. 3 showing the flow of ambient air and combustion air.

FIG. 4 illustrates the circular air circulation pattern of the present invention. A blower (not shown) causes ambient air to flow into preheating chamber 56 and duct 58 where it is initially warmed. The preheated air is then admitted into air circulation chamber 44 through air inlet opening 48. The preheated air, upon being admitted into the air circulation chamber, is caused by baffle 54 to flow in a counterclockwise direction through heat transfer tubes 42 and around the combustion chamber. As the air passes between the upper surface of the combustion chamber and the top wall of the housing it passes over horizontal flue 46. The heated air then flows through air outlet opening 52 and into the area to be heated. This circular pattern increases the contact between the air to be heated and the combustion chamber surfaces which radiate heat. The air also picks up thermal energy from the exposed sides of the flue. This combination of features substantially increases the heat exchange capacity of the system.

Figure 3:
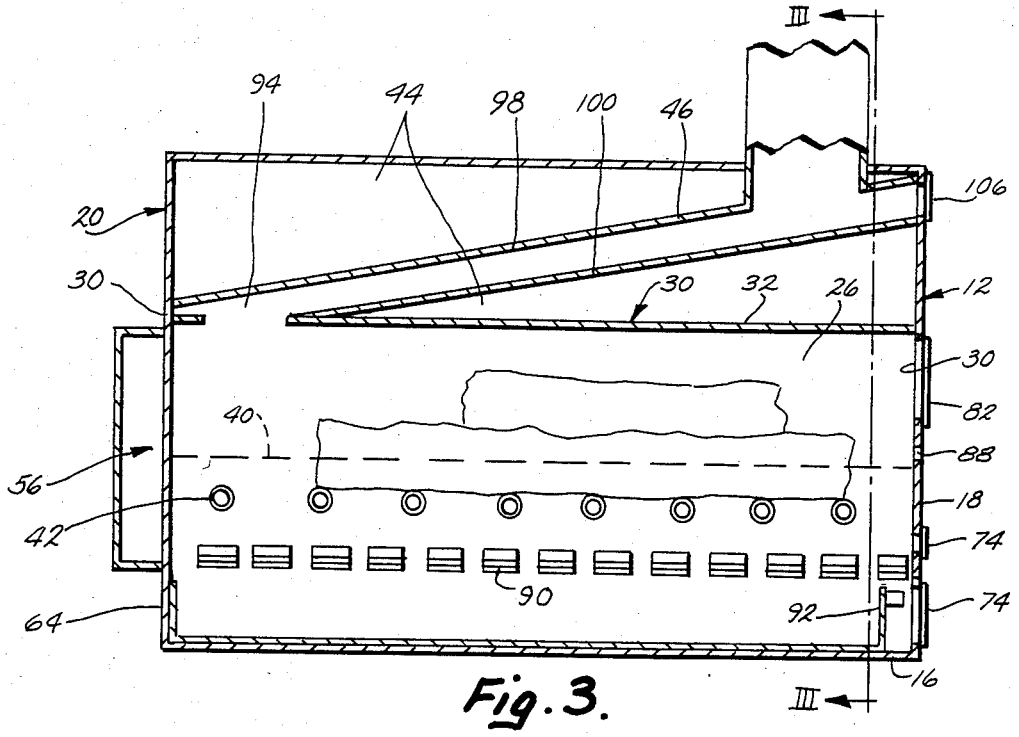
FIG. 3 is a sectional side view of the stove or furnace.

Referring now to the drawings in greater detail, ash pan assembly 40 has a length coextensive with the length of housing 12 and a width which is substantially less than the width of housing 12 (see FIGS. 3 and 4). The ash pan assembly is comprised of a base 60, front and rear walls 62, 64 which are defined by a portion of front and rear walls 18, 20, respectively, of housing 12, and a pair of sidewalls 66. The top 68 of the ash pan assembly is open along its entire length. Access to the interior of ash pan assembly 40 is provided by a grate access opening 70 and an ash collector access opening 72, both of which are located in front wall 18 of housing 12. Each opening is closed by a door 74 mounted in a conventional manner by hinges 76 and secured by latch 78.

Combustion chamber 26 is an elongated, rigid enclosure supported within housing 12 atop sidewalls 66 of ash pan 40. Lower portion 34 of the combustion chamber, which extends between sidewalls 66 includes an opening 35 along its entire length. This opening, in conjunction with the open top 68 of the ash pan assembly, provides a communication between the interior of the combustion chamber and the interior of the ash pan assembly.

Preferably, combustion chamber 26 is cylindrical in shape and housing 12 is rectangular in shape. An advantage of placing a cylindrical combustion chamber within a rectangular housing is that a greater space is provided for the air, resulting in more air being subjected to the radiation of the heat from the combustion chamber. As a result, more heat is absorbed by the air from the surfaces of the combustion chamber. This greatly increases the efficiency of the system.

Another advantage of using a cylindrical combustion chamber is that a cylinder, since it is structurally one of the strongest designs available, does not warp in the presence of intense heat. On the other hand, rectangularly-shaped combustion chambers, due to the presence of corners, do warp in intense heat. In order to prevent warpage, these combustion chambers must be lined with an insulating layer of firebrick or other refractory material. This firebrick decreases the amount of radiant heat transferred through the walls into the air circulation chamber, thus containing the heat in the chamber and increasing the amount of heat lost through the chimney. Because the combustion chamber of the present invention need not be lined with firebrick, more radiant heat is transferred through the chamber walls into the air circulation chamber. This results in substantially greater heat exchange and less heat loss through the chimney. A furnace having an unlined, cylindrical combustion chamber is thus much more efficient at extracting thermal energy for heating ambient air than is a furnace having a rectangular combustion chamber lined with firebrick.

Access to combustion chamber 26 is provided by fuel loading opening 80 through front wall 18 of housing 12. This opening is normally closed by a door 82 mounted in a conventional manner by hinges 84 and secured by latch 86. Draft to combustion chamber 26 is supplied via draft opening 88 located in front wall 18 below loading door 82. A fan may optionally be included to adjust the draft rate through opening 88.

As seen in FIGS. 3 and 4, a number of hollow, open ended heat transfer tubes 42 span ash pan assembly 40 to provide a passageway for air to pass from the portion of the air circulation chamber located on one side of the ash pan assembly to the portion of the air circulation chamber located on the other side of the ash pan assembly. Heat transfer tubes 42 are positioned immediately below combustion chamber 26, in spaced relationship to each other. Tubes 42 define a grate for supporting the logs to be burned. The burning logs directly heat the tubes 42. This thermal energy is transferred across the tube walls and into the interior thereof to heat ambient air passing therethrough.

As the combustion gases and thermal energy released by the fuel rise by convection, a quantity of the thermal energy is exchanged with wall portions 32, 34, 36 and 38 of the combustion chamber. These wall portions, in turn, transfer their heat to the ambient air in the surrounding air circulation chamber 44. In this manner, useful thermal energy is transferred to the circulating ambient air in the air circulation chamber.

A problem with many of the earlier wood burning stoves is that the grate for supporting the logs to be burned is located within the combustion chamber per se. As a result, ashes from the logs fall to the bottom of the combustion chamber. This layer of ashes is believed to act as an insulator to decrease the exchange of thermal energy across the ash covered portion of the combustion chamber wall. Further, since combustion gases rise, the chamber wall located below the fire grate is not directly heated by those superheated gases. Both of these problems decrease the efficiency of heat exchange.

In the present invention the heat transfer tubes, that is the primary grate, are positioned below the outer surface of the combustion chamber. The rising combustion gases thus heat the entire surface of the combustion chamber which increases the exchange of thermal energy into the circulation chamber. Further, the ashes and burning cinders fall below the combustion chamber so that the walls where substantial heat transfer occurs are not covered by an insulating layer of ashes.

In the present invention, a secondary grate 90 is positioned underneath tubes 42 and above base 60 of ash pan 40. The burning cinders falling from the grate above land on this grate and continue to burn. The combustion gases and thermal energy from the burning cinders on secondary grate 90 rise by convection to also heat the heating tubes 42 which in turn transfer their heat to the ambient air passing therethrough.

This primary and secondary grate system of the present invention increases the heating efficiency of the system by utilizing the thermal energy from the burning logs to heat the upper surface of the tubes, and the thermal energy of the burning cinders to heat the lower surfaces of the tubes. In most furnaces, the energy released by cinders is wasted because those cinders are extinguished when they fall into a pile of ashes. The secondary grate in the present invention catches the burning cinders but allows the ashes to fall through, thus preserving those burning cinders for heating the lower surfaces of heating tubes 42.

Ash pan assembly 40 further includes a U-shaped ash collector 92 which is positioned below secondary grate 90 and catches the ashes falling from above. Both secondary grate 90 and ash collector 92 can be removed for cleaning without shutting down the furnace.

Combustion gases are exhausted from combustion chamber 26 by a flue 46. Flue 46 is comprised of an inlet port 94 which is in communication with the interior of combustion chamber 26 through a flue opening 33 located in upper surface 32, an outlet port 96 in communication with the exterior of furnace 10 through a flue opening 15 located in top wall 14 of housing 12, and a body 98 which extends upwardly from combustion chamber flue opening 33 to furnace housing flue opening 15. Preferably, flue opening 33 is located near the rearward end of the combustion chamber and flue opening 15 is located near the frontward end of the housing. The horizontal flue thus extends from the rearward end of the furnace to the frontward end of the furnace, through the air circulation chamber located between top wall 14 of housing 12 and upper surface 32 of combustion chamber 26.

An advantage to locating the combustion flue chamber opening at the rear of the combustion chamber, at the end opposite the draft opening, is that fresh air is drawn from front to back, across the fire, thereby preventing front burn problems. Further, locating the flue opening at the rear requires the gases to progress from front to rear thereby retaining them for a longer time in the combustion chamber rather than exhausting them immediately. In addition, because the horizontal flue extends through the air circulation chamber and is spaced apart from the top wall of the housing and the upper surface of the combustion chamber, ambient air, as it circulates above the combustion chamber, passes around and the combustion chamber, ambient air, as it circulates above the combustion chamber, swirls over, around and beneath horizontal flue 46. The air swirling around the horizontal flue picks up thermal energy radiated from the exposed walls of the flue. By placing the horizontal flue in the air circulation chamber, much of the thermal energy which would be lost out the chimney is transferred to the ambient air circulating past the flue, thereby substantially increasing the heat exchange capacity of the system.

Body 98 of flue 46 has a bottom wall 100 which slopes downwardly toward combustion chamber flue opening 33 so that any distilates, such as creosote, will drain back into combustion chamber 26 and be reburned. Flue body 98 further includes a front wall 102 defined by a portion of front wall 18 of housing 12. Access to the interior of flue chamber 46 is provided by an opening (not shown) that is located in front wall 18 and which is normally closed by a removable plate 106. The plate is held in place by cap screws 108. This opening provides a means for cleaning out any distilate which may accumulate in the interior of the flue.

Figure 2:
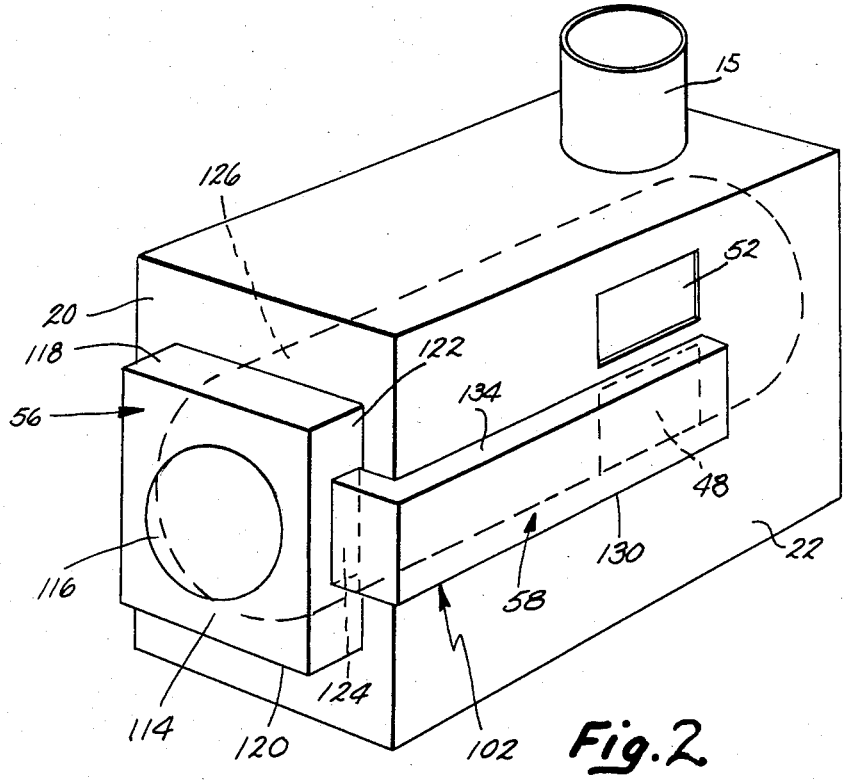
FIG. 2 is a rear, perspective view of the heating stove or furnace of the present invention showing the construction of the preheating system.

As shown in FIGS. 1 and 2, the furnace of the present invention further includes a preheating system 102 comprised of a preheating chamber 56 and a duct 58. The preheating chamber is comprised of a front wall 114 having an air inlet opening 116 located therein, top 118 and bottom 120 walls, and a pair of sidewalls 122, one of which has an air outlet opening 124 located therein, and a rear wall 126 defined by a portion of one of the walls of furnace housing 12. Preferably, preheating chamber 56 is attached to rear wall 20 of housing 12 and is located immediately adjacent the rear wall of the combustion chamber 26. Duct 58 extends along sidewall 22 between outlet opening 124 and air intake opening 48.

A blower (not shown) draws or forces air into preheating chamber 56, then through duct 58 and then admits the air into the air circulation chamber. Air which enters preheating chamber 56 is heated by the thermal energy radiated through rear wall 20 of combustion chamber 26 and in the duct 58 by thermal energy radiated across sidewall 22.

The result of the above described structure of the wood burning furnace of the present invention permits the furnace to give more heat and use less wood than prior wood burning furnaces. The design of the flue decreases the amount of creosote which accumulates therein and permits whatever creosote that does accumulate to be periodically cleaned out. Furthermore, preheating ambient air before it is admitted into the air circulation chamber, circulating the ambient air in a circular pattern about the combustion chamber, circulating air through heat transfer tubes which are heated directly by combustion gases on both their upper and lower surfaces, and circulating air around all surfaces of the horizontal flue permits a more complete heat exchange to the air circulating through the circulation chamber, thereby making the furance substantially more efficient than earlier wood burning furnaces.

In view of the foregoing description, those of ordinary skill in the art will undoubtedly envision various modifications which would not depart from the inventive concepts disclosed. It is expressly intended therefore that the foregoing description is illustrative of the preferred embodiment only and is not to be considered limited. The true spirit and scope of the present invention will be determined by reference to the appended claims.

The embodiments of the invention in which an exclusive property or privilege is claimed are defined as follows:

1. A wood burning furnace comprising:

a furnace housing having front, rear, top, bottom and sidewalls;

a combustion chamber within said furnace housing having an enclosure wall means extending between said front and rear walls of said furnace whereby the said front and rear walls of said furnace housing form the front and rear walls of said combustion chamber, said enclosure wall means of said combustion chamber being spaced inwardly from said top, bottom, and sidewalls of said furnace housing to define an air circulation chamber therebetween;

air intake means for admitting ambient air into said air circulation chamber, whereby said ambient air may circulate within said furnace housing around said combustion chamber;

air exhaust means for exhausting said ambient air into the area to be heated after it has circulated through said air circulation chamber; and ambient air preheating means for preheating said air before it is admitted into said air circulation chamber, said preheating means comprising a preheating chamber located on said rear wall of said furnace housing and combustion chamber whereby heat is directly conducted from said combustion chamber through said rear wall to said preheating chamber and a means for flowing air in said preheating chamber over the outer surface of said rear wall for heating said air previous to circulating said air within said furnace housing and means extending from said preheating chamber to said circulation chamber and communicating therewith to cause the flow of said preheated air from said preheating chamber to said circulation chamber.

2. A wood burning furnace as recited in claim 1 wherein said last mentioned means comprises:

said preheating chamber having an air intake aperture and an air outlet aperture located therein; and duct means having a passageway extending along said furnace housing between said outlet aperture of said preheating chamber and said air intake means.

3. A wood burning furnace as recited in claim 2 wherein said duct means comprises a plurality of walls, one of which is defined by said wall of said housing along which said duct means extends.

4. A wood burning furnace as recited in claim 1 wherein said combustion chamber includes an upper surface in which a flue opening is located near said rear wall thereof; said housing includes a flue opening located in said top wall of said housing near said front wall thereof; and a flue extending upwardly from said combustion chamber flue opening to said housing flue opening for exhausting the combustion directly through and out of said housing flue, said flue extending through said air circulation chamber between said combustion chamber and said housing top wall, whereby air, as it circulates around said combustion chamber, passes either through a passageway between said housing top wall and said flue or a passageway between said combustion chamber and said flue.

5. A wood burning furnace as recited in claim 4 in which said flue is a straight section extending from the combustion chamber flue opening to said housing flue opening, said flue having a bottom wall portion inclined downwardly from said housing flue opening to said flue opening in said combustion chamber which is located over a portion of the combustion chamber in which burning takes place so that creosote accumulating in the flue will run down said inclined wall portions into the combustion chamber and be burned.

6. A wood burning stove as recited in claim 1 wherein said combustion chamber is an elongated cylinder having a length coextensive with the length of said furnace housing.

7. A wood burning furnace as recited in claim 1 further comprising an ash pan assembly having a length coextensive with the length of said combustion chamber and a width substantially smaller than the width of said housing, said ash pan assembly including a pair of sidewalls and an upper opening extending the length thereof, wherein said combustion chamber rests atop said sidewalls of said ash pan assembly, said chamber having an opening extending the length thereof and substantially coextensive with the said opening in said ash pan assembly to provide communication between the interior of said combustion chamber and the interior of said ash pan assembly.

8. A wood burning furnace as recited in claim 7 wherein said combustion chamber is an elongated cylinder and wherein the lengths of said combustion chamber and said ash pan assembly are substantially coextensive with the length of said housing.

9. A wood burning furnace as recited in claim 7 further comprising a plurality of spaced apart heat transfer tubes projecting through said sidewalls of said ash pan assembly for providing an air communication between the portions of said air circulation chamber lying on opposite sides of said ash pan assembly.

10. A wood burning furnace as recited in claim 9 in which said tubes are located immediately below said combustion chamber to define a grate for supporting the logs to be burned.

11. A wood burning furnace as recited in claim 9 further comprising baffle means extending between said furnace housing and said combustion chamber for directing ambient air through said heat transfer tubes after it has been admitted into said air circulation chamber through said air intake means.

* * * * *